US007080581B2

(12) United States Patent
Reese

(10) Patent No.: US 7,080,581 B2
(45) Date of Patent: Jul. 25, 2006

(54) COAXIAL CONNECTOR SOCKET WRENCH

(76) Inventor: Kenneth C. Reese, 632 Sunflower Trail, Orlando, FL (US) 32828

( * ) Notice: Subject to any disclaimer, the term of this patent is extended or adjusted under 35 U.S.C. 154(b) by 141 days.

(21) Appl. No.: 10/900,033

(22) Filed: Jul. 27, 2004

(65) Prior Publication Data

US 2006/0021479 A1 Feb. 2, 2006

(51) Int. Cl.
*B25B 23/143* (2006.01)

(52) U.S. Cl. ..... 81/475; 81/124.2

(58) Field of Classification Search ..... 81/475, 81/124.2

See application file for complete search history.

(56) References Cited

U.S. PATENT DOCUMENTS 3,876,369 A * 4/1975 Behrens ..... 81/475
3,887,981 A * 6/1975 Mazzeo et al. ..... 29/750
4,227,429 A * 10/1980 Bowers et al. ..... 81/176.15
4,346,633 A * 8/1982 Rendl ..... 81/475
4,393,583 A * 7/1983 Zwald ..... 29/857
4,749,251 A * 6/1988 Moulin ..... 385/78
4,964,319 A * 10/1990 Chang ..... 81/58.3
6,474,201 B1 * 11/2002 Lund ..... 81/124.2
6,665,923 B1 * 12/2003 Phillips et al. ..... 29/525.11
6,725,747 B1 * 4/2004 Erwin ..... 81/124.2
6,817,272 B1 * 11/2004 Holland ..... 81/124.2
2004/0035259 A1 * 2/2004 Erwin ..... 81/124.2
2004/0035260 A1 * 2/2004 Adkison ..... 81/124.2
2004/0250660 A1 * 12/2004 Rogers ..... 81/124.2

* cited by examiner

*Primary Examiner*—David B. Thomas
(74) *Attorney, Agent, or Firm*—Welsh & Katz, Ltd.

(57) ABSTRACT

A slotted torque wrench has an elongated stem that extends between a handle and a socket for a nut. The slot extends through one face of the socket and at least partially along the stem. A torque limiter couples the socket to the handle.

19 Claims, 4 Drawing Sheets

COAXIAL CONNECTOR SOCKET WRENCH

FIELD OF THE INVENTION

The invention pertains to torque wrenches usable in connection with electrical connectors. More particularly, the invention pertains to socket-type torque wrenches suited for use with high density, miniature RF connectors.

BACKGROUND OF THE INVENTION

A variety of known connectors are available for use with coaxial cable. These include SMA, SSMA, and SMC-type coaxial connectors. Such connectors are available in both straight and right angle configurations with threaded studs to which the coaxial cables are connected.

It has been recognized that it is important to tighten the cables to such connectors to specific torque values. Since such connectors are often used in very high density environments, such as avionics and the like, the connectors are often very tightly packed. This can create difficulties in attempting to properly torque each connector.

Torque wrenches are known for use with connectors as described above. However, in high density environments, the connectors are too closely spaced to be able to use known torque wrenches.

There continues to be a need for torque wrenches usable in connection with high density miniature and sub-miniature connectors. Preferably, such torque wrenches would not only be usable in high density environments to properly torque each connector, they will also be cost effective to manufacture in a variety of sizes to be usable with different nut sizes, are required by SMA, SSMA, SMC and other types of high density connectors.

DETAILED DESCRIPTION OF THE EMBODIMENTS

Figure 1:
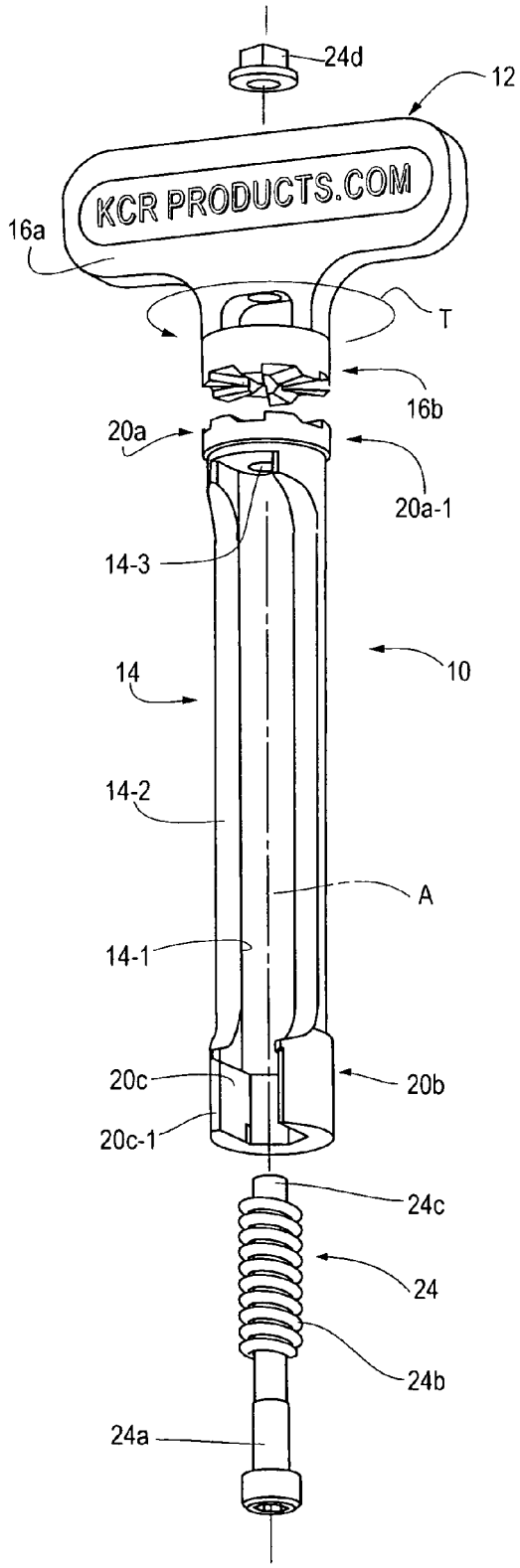
FIG. 1 is an exploded view of the torque wrench in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

A torque wrench which embodies the invention incorporates an elongated hollow stem with a slot extending therealong. One end of the stem is coupled, via a torque limiting mechanism, to a handle. The other end of the stem carries a socket of a selected size. The slot extends through one of the faces of the socket.

It will be understood that a variety of torque limiting mechanisms could be incorporated into the present torque wrench without departing from the spirit and scope of the present invention. A disclosed embodiment incorporates an elongated coil spring carried by the handle so as to bias the stem toward the handle.

The handle and the adjacent end of the stem carry a plurality of mating surfaces. One set of surfaces is oriented such that as applied torque increases to a preset limit, the handle will decouple and slip relative to the stem.

The torque mating surfaces are configured so that torque is limited when tightening a nut on a threaded stem. The mating surfaces are configured such that no such limitation exists when the wrench is rotated in the opposite direction so as to uncouple the nut from the respective threads. The present torque wrench can be used with connectors having both internal or external threads.

FIG. 1 is an exploded view of a torque wrench 10 in accordance with the invention. The wrench 10 includes a generally T-shaped handle 12 which is rotatably coupled to an elongated hollow stem 14. The handle 12 has a manually manipulatable section 16*a* which is generally oriented to be perpendicular to a center line A of the stem 14. The handle 12 terminates at a plurality of surfaces 16*b* radially disposed about the center line A of the stem 14.

The stem 14 has a first end 20*a* and a second end 20*b*. The first end 20*a* carries a plurality of surfaces indicated generally at 20*a*-1. The surfaces 20*a*-1 are radially disposed about the center line A of the stem 14 and, as discussed in more detail subsequently, engage the surfaces 16*b*.

The end 20*b* carries a socket 20*c* of a selected size and configuration depending on the style and type of nut to be tightened. It will be understood that neither the size nor the configuration of the socket 20*c* are limitations of the present invention.

Stem 14 defines an interior hollow region 14-1 which extends at least part way along stem 14 extending from socket 20*c*. The internal region 14-1 is exposed by slot 14-2 which extends at least part way along stem 14. The socket 20*c* exhibits a mating slot 20*c*-1 which is generally coextensive with the slot 14-2.

Portions of a torque limiting mechanism 24 include a threaded member or screw 24*a* which carries a coil spring 24*b*. The element 24 is slidably received within the stem 14. An end 24*c* of the connector 24*a* extends through a centrally located opening 14-3 of stem 14, adjacent to surfaces 20*a*-1, through an adjacent opening or boring 16*c*, best seen in FIG. 3, whereat the end 24*c* engages nut 24*d*. Member 24 when coupled to nut 24*d* rotatably attaches the handle 12 to the stem 14.

As discussed below, to tighten a nut, socket 20*c* is slid onto the nut and handle 12 is rotated in a direction T so as to screw the nut onto the respective threaded member. Element 24 in combination with surfaces 16*b* and 20*a*-1 limits tightening torque of the nut onto the receiving threads. To remove a nut, handle 12 is rotated opposite the direction T.

Figure 2:
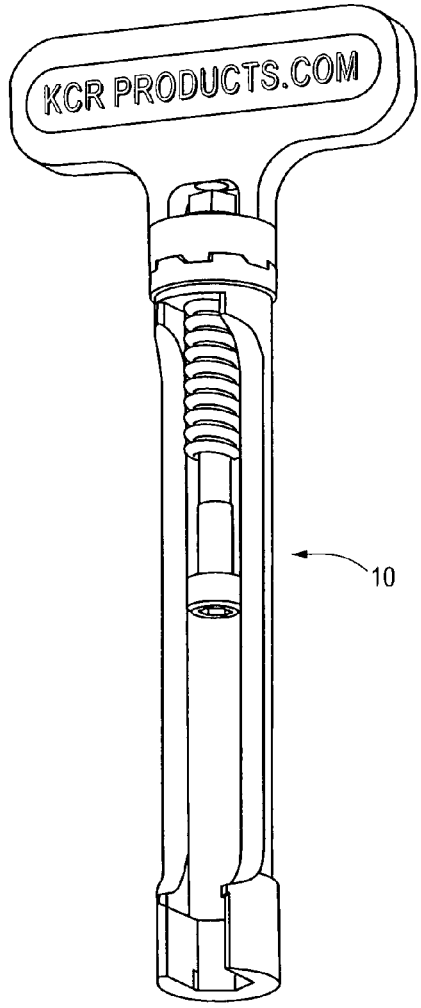
FIG. 2 is an isometric view of the torque wrench of FIG. 1.
Figure 3:
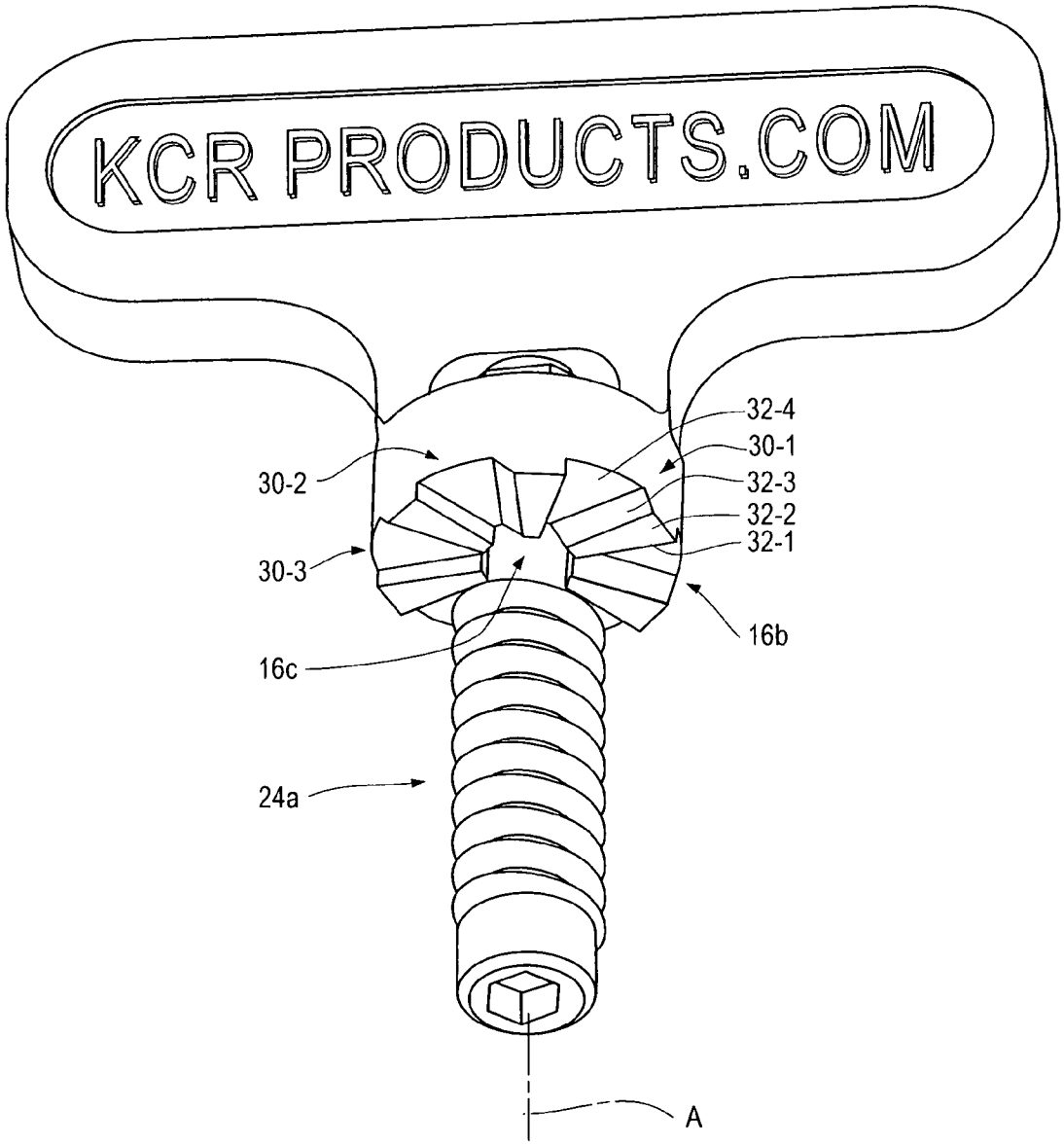
FIG. 3 is an enlarged view of a handle of the torque wrench of FIG. 1.
Figure 4:
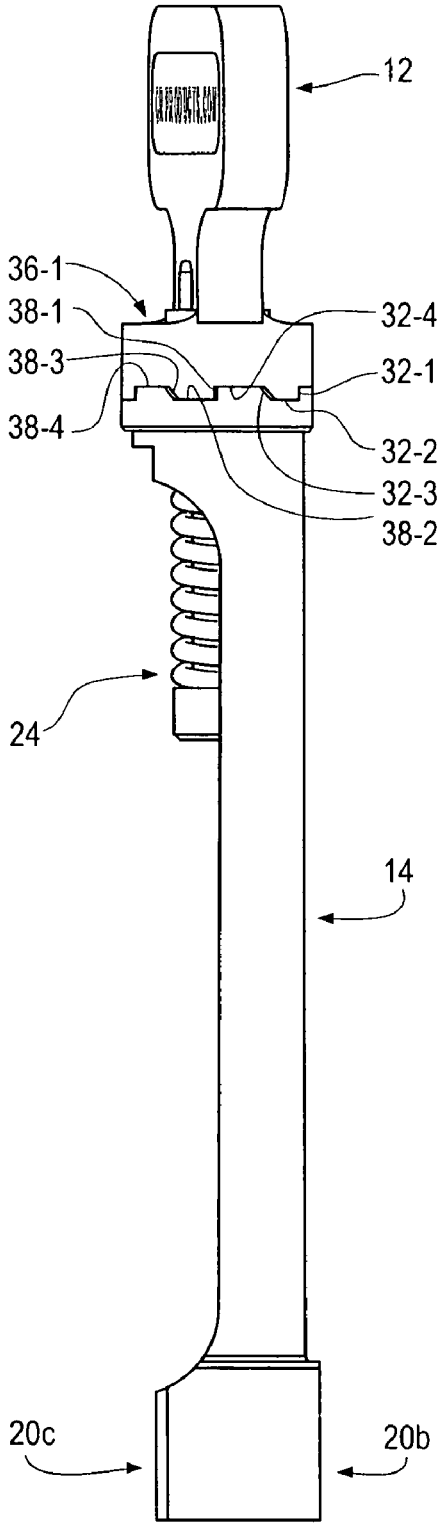
FIG. 4 is a side view illustrating additional features of the torque wrench of FIG. 1.

FIGS. 2–4 illustrate alternate views and additional details of the wrench 10. As illustrated therein, surfaces 16*b* include a plurality of identical multi-surfaced regions 30-1, -2, . . . -n disposed radially about a center line of the threaded element 24*a*.

The plurality of regions 30-1, -2, -3 . . . -n are identical and a description of region 30-1 is applicable to all of the others. The region 30-1 incorporates a surface 32-1 which extends generally parallel to central axis A of the stem 14 and element 24*a*. Surface 32-1 intersects planar angular surface

32-2 which extends radially relative to the axis A and perpendicular thereto. The radial surface 32-2 intersects biased surface 32-3.

The biased surface 32-3 which extends radially relative to the central axis A is at a selected angle relative to the surface 32-2 to implement the torque limiting feature of the wrench 10. The surface 32-3 intersects a planar wedge shaped surface 32-4 which extends radially relative to the axis A and parallel to the surface 32-2.

The surfaces 20*a*-1 carried on end 20*a* of stem 14 form a plurality of surfaces 36-1, -2 . . . -n which engage the previously discussed pluralities of surfaces 32-1, -2, -3 and -4. As best seen in FIG. 4, one of those pluralities of surfaces 36-1 includes a first surface 38-1 which extends generally parallel to the axis A and surface 32-1. The surface 38-1 intersects a radially extending surface 38-2 which extends parallel to the surface 32-2 relative to each of the pluralities 36-1, -2 . . . -n. The surface 38-2 intersects a surface 38-3 which is parallel to surface 32-3. Finally, the surface 38-3 intersects surface 38-4 which extends parallel to the surface 32-4.

As the handle 12 is rotated in the direction T tightening a threaded member or a nut contained in the socket 20*c*, the surfaces 32-3, 38-3, slide upon one another in opposition to the retaining force exerted by the coil spring 24*b*. As would be understood by those of skill in the art, the angle and length of the surfaces 32-3, 38-3 and the spring constant of the coil spring 24*b* in combination establish a maximum torque which can be exerted by the socket 20*c* in tightening the respective threaded member. When that torque limit is reached, the surfaces 32-3, 38-3 disengage.

To disconnect a threaded member or nut, the handle 12 of the wrench 10 is rotated in a direction opposite the direction T which causes surfaces 32-1 and 38-1 to engage one another transferring the torque from handle 12 to the socket 20*c* for purposes of releasing the threaded member.

Figure 5:
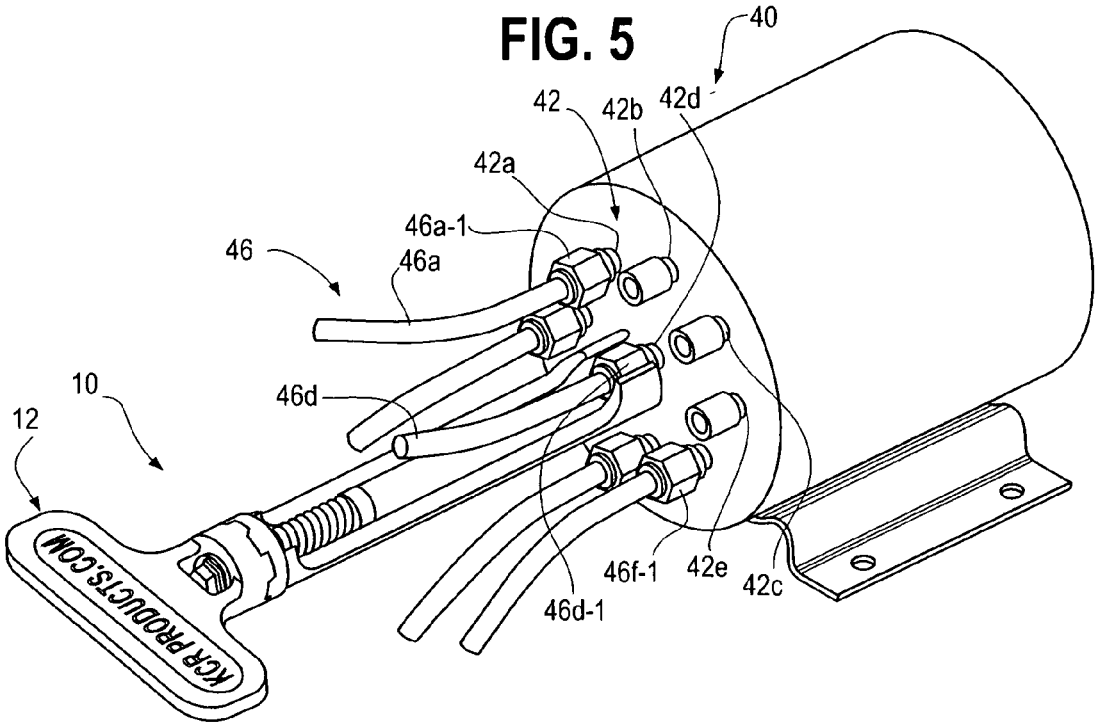
FIG. 5 is a perspective view illustrating use of the torque wrench of FIG. 1.
Figure 6:
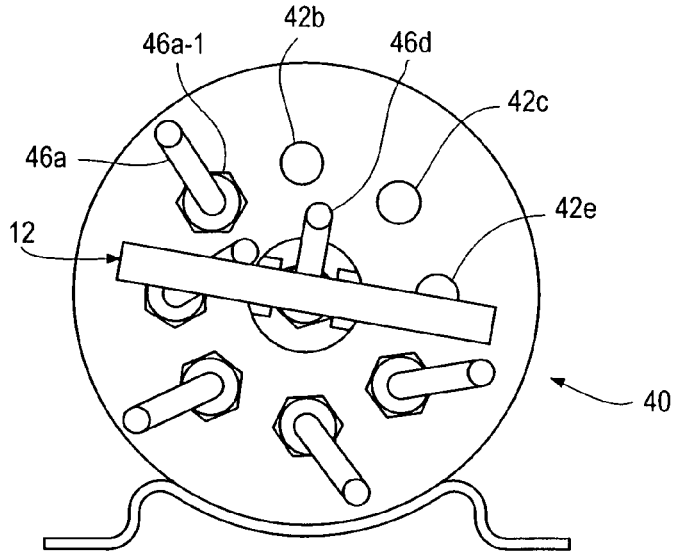
FIG. 6 is another view illustrating use of the torque wrench of FIG. 1.

FIGS. 5 and 6 illustrate an exemplary element 40, which might be a portion of an RF or microwave circuit, and which carries a relatively high density plurality of threaded connectors 42, such as 42*a*, 42*b* . . . 42*k*. Each of the exemplary connectors 42 exhibits a threaded stud which could have an interior or an exterior thread all without limitation.

A plurality of coaxial cables indicated generally at 46 is to be screwed onto or coupled to the connectors 42. It will be understood that the connectors 42 can exhibit a variety of geometries without departing from the spirit and scope of the present invention. They can include, for example, without limitation, SMA, SSMA or SMC-type connectors.

Each of the coaxial cables, such as cable 46*a* carries a termination nut or element 46*a*-1. Each of the connector elements or nuts 46*a*-1, -2 . . . -m is to be coupled to a respective connector 42*a, b, c* . . . with an appropriate torque. As illustrated in FIGS. 5 and 6, the wrench 10 is well suited for use with high density conductor configurations.

The socket 20*c* slidably engages the nut or connector element such as 46*a*-1, 46*b*-1, 46*c*-1 . . . with the respective coaxial cable 46*a, b* . . . extending from the slot 14-2. Handle 12 is rotated in the direction T to tighten the connector element or nut 46*a*-1, 45*b*-1, 46*c*-1 . . . onto the respective threaded member 42*a, b, c* . . . with the appropriate torque.

Once the appropriate torque has been reached, the torque limiting mechanism including element 24, surfaces 16*b* and surfaces 20*a*-1 disengage handle 12 from socket 20*c*. The user at that point can remove the wrench 10 from the connector.

Advantageously, the slot 14-2 of stem 14 and 20*c*-1 in socket 20*c* facilitate convenient and efficient disconnection of the wrench 10 from not only the nut or connector element 46*a*-1 but also from the respective RF cable such as 46*a*. The T-shaped handle 12 makes it easy and convenient for the user to quickly tighten the threaded element 46*a*-1 onto the respective connector member, such as 42*a*, without having to worry about exceeding the specified connecting torque.

It will be understood that the wrench 10 can exhibit a plurality of different socket sizes and configurations without departing from the spirit and scope of the present invention. Additionally, none of the configuration of the connectors, such as the connector 42*a, b* . . . represent a limitation of the present invention. The slot need only extend through socket 20*c* if desired.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A torque wrench comprising:

a handle; and an elongated stem having a hollow interior, the stem has first and second ends, one end is rotatably coupled, by a torque limiting mechanism to the handle, the other end carries a nut engaging socket, the stem defines an elongated slot therealong, the slot is coupled to the hollow interior where the mechanism includes a spring which expands as torque increases.

2. A wrench as in claim 1 where the slot extends through at least part of the socket.

3. A wrench as in claim 2 where the handle defines a first set of circumferential surfaces and the stem defines a second set of mating circumferential surfaces.

4. A wrench as in claim 3 where the surfaces slidably engage one another where the handle is rotating in a torque limiting direction.

5. A wrench as in claim 4 where the surfaces blockingly engage one another where the handle is rotating in a direction opposite to the torque limiting direction.

6. A wrench as in claim 1 where the where the handle defines a first set of circumferential surfaces and the stem defines a second set of mating circumferential surfaces.

7. A wrench as in claim 6 where the spring biases the first and second sets of surfaces toward one another.

8. A wrench as in claim 7 where the spring, in combination with the surfaces establishes, at least in part, an upper torque limit.

9. A wrench as in claim 6 where the first set comprises a plurality of substantially identical surface combinations with each combination including, a first radially directed planar surface oriented so as to be generally parallel to a central axis of the stem and a second radially directed planar surface oriented at an acute angle relative to the central axis of the stem.

10. A wrench as in claim 9 where the second set comprises a second plurality of substantially identical surface combinations with each such combination comprising at third radially directed planar surface oriented so as to be generally parallel to a central axis of the stem and a fourth radially directed planar surface oriented at an acute angle relative to the central axis of the stem.

11. A wrench as in claim 10 where the first and third surfaces abut each other when the handle is rotated in a non-torque limiting direction.

12. A wrench as in claim 10 where the second and fourth surfaces slidably engage one another when the handle is rotated in a torque limiting direction.

13. A wrench as in claim 1 where the spring establishes, at least in part, an upper torque limit.

14. A torque wrench as in claim 1 where the slot extends in part axially along the stem.

15. A torque wrench comprising:

a generally T-shaped handle with a center line;

a plurality of surfaces carried on the handle at an acute angle to the center line and radially disposed thereabout;

a socket with an elongated connecting member that terminates in a second plurality of surfaces which slidably engage members of the first plurality to couple a limited torque from the handle to the socket where the handle and stem are rotatably coupled by a compression spring which expands as torque increases.

16. A torque wrench comprising:

a handle;

an elongated cylindrical stem rotatably coupled to the handle, the stem having an end displaced from the handle;

a socket carried on the end of the stem, the socket having an interior configuration that matches that of a selected fastener element with a slot formed at least in the socket and a spring, where the spring expands as torque coupled between the handle and the stem increases.

17. A torque wrench as in claim 16 which includes a torque limiting element such that the handle rotatably slips relative to the stem when a predetermined torque is exceeded.

18. A torque wrench as in claim 16 where the spring is coupled between the handle and stem for biasing the handle toward the stem.

19. A torque wrench as in claim 16 where the slot extends in part axially along the stem.

* * * * *